United States Patent [19]

Clark

[11] Patent Number: 4,796,016

[45] Date of Patent: Jan. 3, 1989

[54] PIXEL ROUNDING METHOD AND CIRCUIT FOR USE IN A RASTER SCAN DISPLAY DEVICE AND A RASTER SCAN DISPLAY DEVICE COMPRISING SUCH CIRCUIT

[75] Inventor: David G. Clark, Redhill, England

[73] Assignee: U.S. Philips Corporation, New York, N.Y.

[21] Appl. No.: 859,945

[22] Filed: May 5, 1986

[30] Foreign Application Priority Data

May 13, 1985 [GB] United Kingdom ..... 8512048

[51] Int. Cl.[4] ..... G09G 1/16

[52] U.S. Cl. ..... 340/750; 340/728; 340/748

[58] Field of Search ..... 340/728, 744, 748, 750

[56] References Cited

U.S. PATENT DOCUMENTS

| | | | |
|---|---|---|---|
| 2,921,124 | 1/1960 | Graham | 340/728 |
| 3,680,076 | 7/1972 | Duffek et al. | 340/728 |
| 3,786,478 | 1/1974 | King, Jr. | 340/728 |
| 3,878,536 | 4/1975 | Gilliam | 340/728 |
| 3,969,716 | 7/1976 | Roberts | 340/728 |
| 4,129,860 | 12/1978 | Yonezawa et al. | 340/728 |
| 4,215,414 | 7/1980 | Huelsman | 340/728 |
| 4,239,459 | 12/1980 | Houldsworth | 340/728 |
| 4,649,380 | 3/1987 | Penna | 340/728 |

FOREIGN PATENT DOCUMENTS

| | | |
|---|---|---|
| 1343298 | 1/1974 | United Kingdom . |
| 1515506 | 1/1978 | United Kingdom . |

*Primary Examiner*—Marshall M. Curtis
*Assistant Examiner*—Mahmoud Fatahi-Yar
*Attorney, Agent, or Firm*—Marianne R. Rich

[57] ABSTRACT

A pixel rounding method and circuit for bit-map graphics displays. The pixel codes are divided into two groups "high" and "low", and pixels with "high" groups codes are rounded against pixels with "low" group codes. The rounding can be prerounding or post-rounding and involves extending a rounded pixel part-way into the adjacent (preceding or succeeding) pixel position. Rounding decisions are made by detecting diagonal relationships of "high" and "low" group codes in blocks in four pixel codes. A rounding circuit receives a pixel code stream and produces a version thereof which is delayed by one pixel period. In accordance with the rounding decisions, the original and delayed pixel code streams are selectively switched each half pixel period to provide a resultant pixel code stream which is used to generate the display.

13 Claims, 4 Drawing Sheets

Fig.5.

| | pp1 | pp2 | pp3 | pp4 | pp5 | pp6 | |
|---|---|---|---|---|---|---|---|
| F | P1 | P2 | P3 | P4 | P5 | | (i) |
| F' | | P1 | P2 | P3 | P4 | P5 | (ii) |
| R(P1'-P5') | 0 | 0 | 1 | 0 | 0 | | (iii) |
| F(P1-P5) | 0 | 1 | 0 | 1 | 0 | | (iv) |
| PC (1/0) | | | | | | | (v) |
| G31 | 0 | 0 | 0 | 1 | 0 | | (vi) |
| G32 | 1 | 1 | 0 | 1 | 1 | | (vii) |
| SS (1/0) | | | | | | | (viii) |
| RPS | P1 | P1 P2 | P2 P2 | P4 P4 | P4 P5 | P5 | (ix) |

Fig.6.

| | pp1 | pp2 | pp3 | pp4 | pp5 | pp6 | |
|---|---|---|---|---|---|---|---|
| F | P1 | P2 | P3 | P4 | P5 | | (i) |
| F' | | P1 | P2 | P3 | P4 | P5 | (ii) |
| R(P1''-P5'') | 1 | 0 | 0 | 0 | 1 | | (iii) |
| F(P1-P5) | 0 | 1 | 0 | 1 | 0 | | (iv) |
| PC (1/0) | | | | | | | (v) |
| G31 | 0 | 1 | 0 | 0 | 0 | | (vi) |
| G32 | 1 | 1 | 1 | 1 | 0 | | (vii) |
| SS (1/0) | | | | | | | (viii) |
| RPS | P1 | P2 P2 | P2 P3 | P3 P4 | P4 P4 | P5 | (ix) |

PIXEL ROUNDING METHOD AND CIRCUIT FOR USE IN A RASTER SCAN DISPLAY DEVICE AND A RASTER SCAN DISPLAY DEVICE COMPRISING SUCH CIRCUIT

BACKGROUND TO THE INVENTION

The invention relates to a pixel rounding method for displaying on a screen of a raster scan display device, a plurality for information pixels, each of which is represented by a respective digital code stored in a display memory, said digital codes being accessed repeatedly to display the information pixels in a recurrent cycle of scanning lines, with each row of information pixels being displayed twice in adjacent scanning lines.

Hereinafter, the display comprising such a quantity of pixel information will be referred to as a "display page". The scanning technique which is employed can be a line sequential frame scan or an interlaced two-field scan, provided that each line of pixels is displayed twice in adjacent scanning lines of the raster scan.

In a data display arrangement of the above type, the stored digital codes can be in so-called "bit-map" form comprising at least one information bit in respect of each of the pixels which are to be displayed on the screen of the display device by the scanning action. These information bits are read out in synchonism with the scanning action in such manner as to display successive rows of pixels of the display twice, either in the same scanning lines of the scanning cycle in each field in the case of an interlaced two-field scan, or in successive pairs of scanning lines of the scanning cycle in the case of a line sequential frame scan. The information bits which are read out are applied to a display generator which is responsive thereto to produce a video signal containing the pixel information for driving the display device to produce the "bit-map" display.

Alternatively, in a data display arrangement of the above type, the stored digital codes can be in so-called "character based" form. For the alternative, there is provided, e.g. in the display generator, a store of standard character shapes comprised by patterns of bits, and the codes stored in the display memory are read out recurrently during the scanning action to identify selected character shapes whose bit patterns are read out progressively to be formed into the video signal for driving the display device. The successive rows of pixels which in this instance define the shapes of the displayed characters are displayed twice, as before, to produce in this instance a "character based" display.

A typical character format is a co-ordinate matrix composed of 35 discrete dots arranged in 7 rows and 5 columns, each dot of a character representing a respective bit of the relevant bit pattern.

A PROBLEM AND ITS KNOWN SOLUTION

As displayed, certain character shapes which are derived from such a character format tend to have an unpleasant jagged appearance (known as the "stair-case effect") due to diagonal relationships of dots in adjacent rows. In order to improve the shape of such characters, it is known to employ "character rounding" which involves smoothing out the jagged appearance by means of half dots inserted in the "stair-case" steps which are formed by the diagonally disposed dots. This "character rounding" technique is described in United Kingdom patent specifications 1 343 298 and 1 515 606.

FURTHER ASPECTS OF THE ART

A diagonal detection and logic circuit for performing the "character rounding" technique can be organised, for each character shape to be displayed. The bits representing the particular row of character dots being displayed in the current scanning line are stored and also at the same time the bits representing either the immediately preceding dot row of the character, or the immediately succeeding dot row of the character are stored, according to whether the dot row is being displayed for the first time or the second time (i.e. the display is in the "odd" field or in the "even" field in the case of an interlaced two-field scan). The logic circuit then is responsive to this temporarily stored bit information to cause, firstly, each dot of the row when it is produced, to extend partway into the preceding dot position upon detecting the presence of a dot in that preceding dot position in either the immediately preceding or the immediately succeeding dot row, as the case may be, and also the absence of a dot in one or the other such dot row in the position corresponding to that of the dot being produced. Secondly each dot of the row when it is produced extends into the succeeding dot position upon detecting the presence of a dot in that succeeding dot position in either the immediately preceding or the immediately succeeding dot row, as the case may be, and also the absence of a dot in one or the other such dot row in the position corresponding to that of the dot being produced.

SUMMARY AND OBJECT OF THE INVENTION

The present invention proposes an implementation of a diagonal detection and logic circuit which can perform a rounding technique for a "bit-map" display. However, it has been found that problems are encountered with such an implementation. One problem is that whereas for a "character based" display the functional division between displayed characters and background is clear, (because there is only a limited set of characters each of known shape) no such distinction exists with a "bit-map" display. Therefore, what is to be rounded against what, is not so readily determinable with a "bit-map" display. Another problem is that in order to detect the diagonal relationship of pixels in adjacent scanning lines, access to the information bits for the preceding or succeeding pixel scanning lines (on odd/even fields) is required as set forth above. For a "character based" display, this can be readily achieved by reading out twice from the display memory in a scanning line the stored digital code for a selected character shape. One read out operation is used to obtain from the relevant bit pattern the row of bits for the dot row currently being displayed in the current scanning line, and the other read out operation is used to obtain the rows of bits for the dot row for either the preceding or the succeeding scanning line, as the case may be. Because a new digital code is only required every few dot (pixel) periods along a scanning line, the rate of read-out from the display memory can be relatively slow, so that this double read-out operation is practicable. In contrast, the display memory for a "bit-map" display is generally required to be read every pixel period. This read-out is fairly demanding and to double it for rounding purposes may not be practicable.

It is an object of the present invention to provide for "bit-map" displays a rounding method which overcomes the above-mentioned problems. The object of the invention is solved by a pixel rounding method for displaying on a screen of a raster scan display device, a plurality of information pixels, each of which is represented by a respective digital code stored in a display memory, said digital codes being accessed repeatedly to display the information pixels in a recurrent cycle of scanning lines, with each row of information pixels being displayed twice in adjacent scanning lines and wherein each digital code either belongs to a dominant group of codes or to a non-dominant group of codes. The method comprises the steps of:

(a) obtaining from the display memory, in such manner as to make available in each scanning line period, the digital codes of the current row of information pixels for the current scanning line as undelayed fundamental pixel information and producing a second version thereof which is delayed by one pixel period as displayed fundamental pixel information.

(b) obtaining from the display memory, the digital codes of the preceding row of information pixels when it is the first occurrence of the current row of information pixels, as reference information, but the digital codes of the succeeding row of information pixels when it is the second occurrence of the current row of information pixels, as reference information;

(c) detecting allocations to said two groups of two successive undelayed fundamental information pixels and two successive reference information pixels coincidently available, for the existence of allocation of two diagonally opposed information pixels to said dominant group and a further fundamental information pixel to said non-dominant group, such allocation representing a predetermined diagonal relationship;

(d) upon absence of such detecting, selecting for producing the pixel display in the second half of each pixel period the undelayed fundamental pixel information and in the first half of the next pixel period the delayed fundamental pixel information;

(e) but upon detecting a first predetermined diagonal relationship prerounding a pixel allocated to said dominent group by selecting for said first half of a pixel period the undelayed fundamental information and upon detecting a further predetermined diagonal relationship postrounding a pixel allocated to said dominant group by selecting for the second half of a pixel period the delayed fundamental information, such prerounding and postrounding thereby suppressing a half pixel originally allocated to said non-dominant group.

In this rounding method, the switching between the fundamental pixel information and the delayed version thereof for successive half pixel periods provides a simple means for prerounding, no rounding, or postrounding the displayed pixels, depending on the switching order.

Preferably, for step (b) of the above rounding method, the digital codes for the preceding scanning line of pixels are obtained by delaying the digital codes for each scanning line by one line scan period followed read out of these digital codes from the display memory. In this way, the read out rate from the display memory is not doubled, as it would be if the digital codes for both the current and the preceding scanning line of pixels were required to be read out from the display memory in the current scanning line.

FURTHER ASPECTS OF THE INVENTION

A pixel rounding circuit for performing the rounding method can comprise:

(i) a first multiplexer having a first input to which the fundamental pixel information is applied;

(ii) a latch to which the fundamental pixel information is also applied and which is operable at pixel clock rate to produce the delayed version of the fundamental pixel information, a second input of the first multiplexer having this delayed version of the fundamental pixel information applied to it;

(iii) two group decoders to which the fundamental and the reference pixel information are applied, respectively, and which are operable to produce a logic 0 or a logic 1 output according as the digital codes forming the pixel information applied to them belong to either one of two groups as determined by the decoders;

(iv) two flip-flops having inputs connected respectively to outputs of the two group decoders, which flip-flops are driven at pixel clock rate so as to produce at respective outputs the logic O or 1 value applied to their inputs from the relevant decoder in the preceding pixel period, (v) two AND-gates each having four inputs connected respectively to the two decoder outputs and the two flip-flop outputs, one AND-gate producing a logic 1 output to request pixel prerounding and the other AND-gate producing a logic 0 output to request pixel postrounding, and (vi) a second multiplexer which has first (prerounding) and second (postrounding) inputs connected respectively to the outputs of the two AND-gates, and an output which is connected to a switching input of the first multiplexer, said second multiplexer being switched at pixel clock rate to connect its output to its prerounding input for the first half of each pixel period and to connect its output to its postrounding input for the second half of each pixel period, a resultant switching signal at the second multiplexer output switching the first multiplexer so as to connect an output thereof to its first input when the switching signal is at logic 1 value and to its second input when the switching signal is at logic 0 value.

The output signal from the first multiplexer output forms the resultant pixel information for producing the pixel display. As will be described, the timing of the switching is delayed by one half a pixel period. This enables the fundamental pixel information streams (original and one pixel period delayed) to be selected as required in each half pixel period to provide prerounding and postrounding.

For the determination of the fundamental and reference pixel information, in dependence on whether it is the first occurrence (odd fields) or the second occurrence (even fields) of the current scanning line in the raster scan, the rounding circuit can comprise an input stage having a line store connected to receive and store the digital codes for each scanning line of pixels read from the display memory. This line store is driven at the pixel clock rate so as to produce at its output the stored digital codes delayed by one scan line period. The input stage also includes a third multiplexer having first and second inputs connected to receive the digital codes for the current scanning line as read from the display memory and third and fourth inputs connected to receive the digital codes for the preceding scanning line as produced at the output of the line store. The third multiplexer is switched so that for the first occurrence of the current scanning line its first input is connected to a first output thereof to provide the digital codes for the current scanning line as the fundamental pixel information, and its third input is connected to a second output thereof to provide the digital codes for the preceding scanning line as the reference pixel information. For the second occurrence of the current scanning line the fourth input of the third multiplexer is connected to the first output to provide the digital codes for the preceding scanning line as the fundamental pixel information, while its second input is connected to the second output to provide the digital codes for the current scanning line as the reference pixel information.

The invention also relates to a raster scan display device comprising such a circuit. Further advantageous aspects of the invention are recited in the further independent Claim and dependent Claims.

BRIEF DESCRIPTION OF THE DRAWINGS

In order that the invention may be more fully understood, reference will now be made by way of example to the accompanying drawings, of which.

Figure 4:
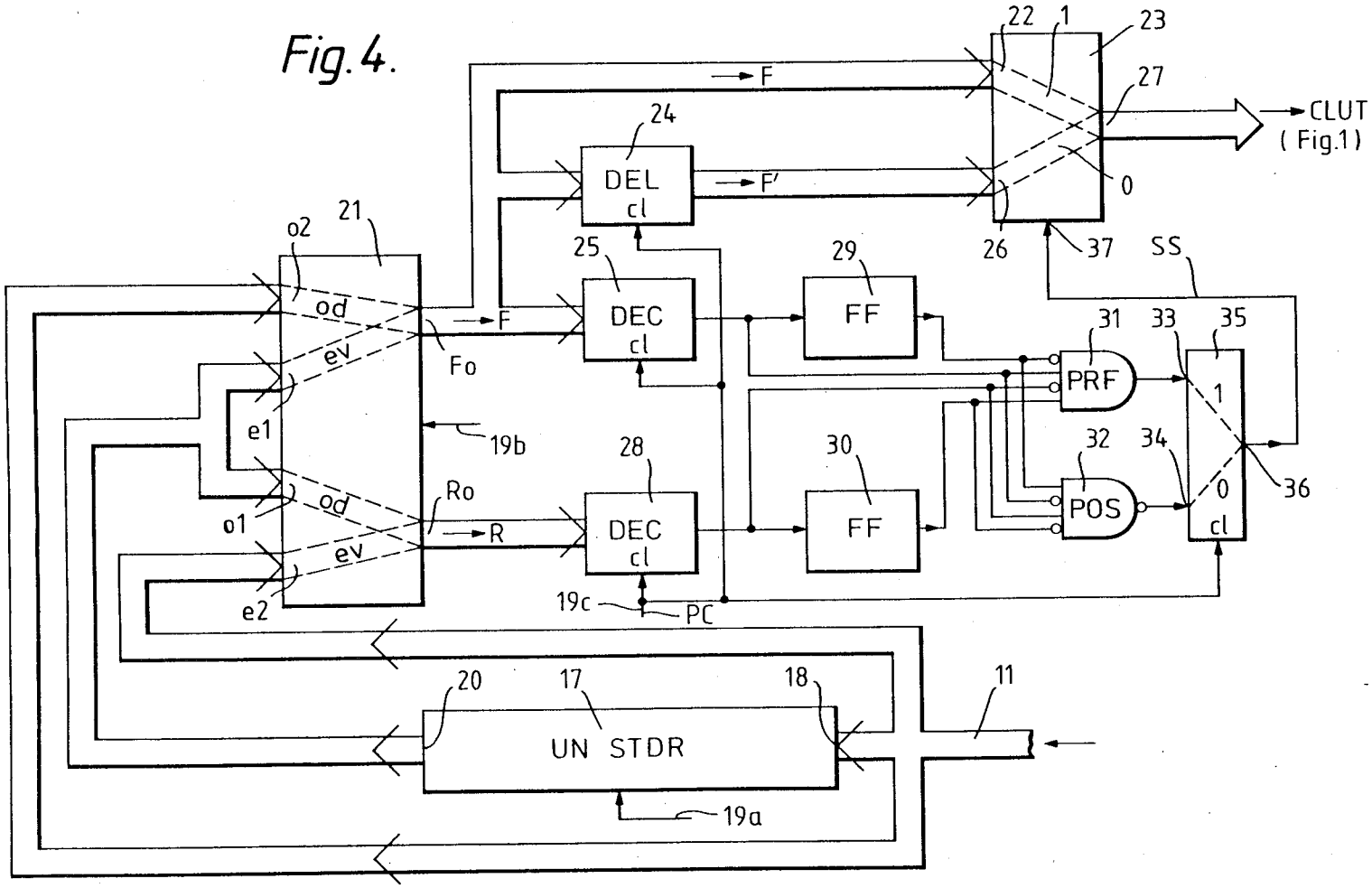

FIGS. *3a*, *3b* show a first principle of rounding in accordance with the present invention;

FIG. 4 shows diagrammatically a rounding circuit in accordance with the present invention;

FIGS. 5 and 6 show timing diagrams for explaining the operation of the rounding circuit of FIG. 4; and FIGS. *7a* . . . *7f* illustrate a modified principle of rounding in accordance with the present invention.

DESCRIPTION OF A DATA DISPLAY ARRANGEMENT

Figure 1:
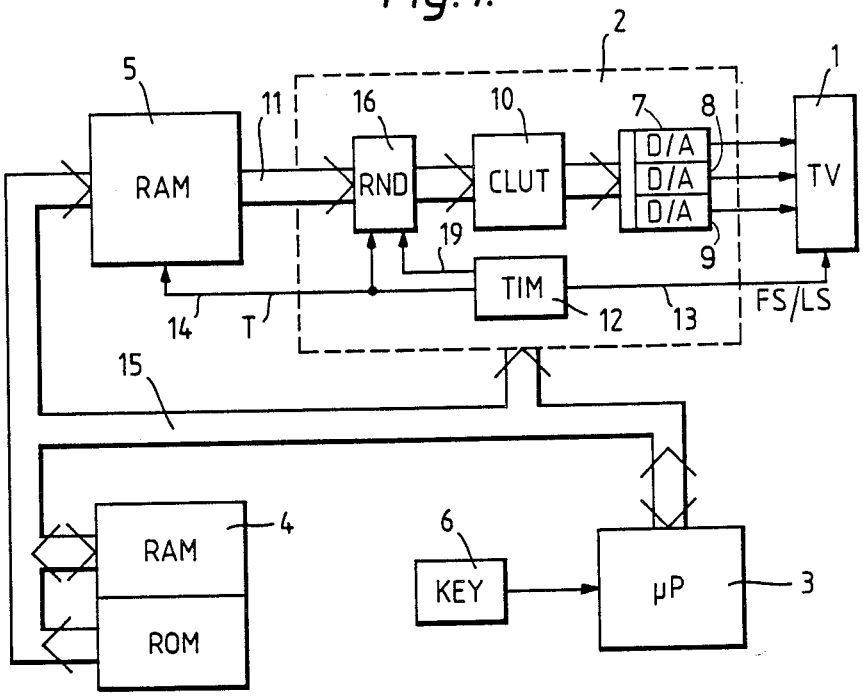
FIG. 1 shows diagrammatically a data display arrangement in which the present invention can be embodied.

Referring to the drawings, the data display arrangement shown in FIG. 1 comprises a display device 1, a display generator 2, a processor 3, a background memory 4, a display memory 5 and user interface apparatus 6. The display device 1 is suitably a colour television monitor TV which has an interlaced two-field (odd and even) raster scan and which is connected to receive R,G,B, video signals from the display generator 2. These R,G,B, video signals are produced in the display generator 2 by three digital-to-analogue converters (D/A)7, 8 and 9, respectively. (In certain fields of use the display may be monochromic only). This display generator 2 also includes a colour/attribute look-up table (CLUT) 10 which is suitably a read/write memory and is responsive to pixel information received into the display generator 2 from the display memory 5 over a bus 11 to produce digital signals for driving the converters 7, 8 and 9. A display timer (TIM) 12 in the display generator 2 provides line and field synchronisation signals LS and FS for the television monitor 1 over a connection 13. The timer 12 also provides over a connection 14 timing signals T for controlling the readout of pixel information from the display memory 5 onto the bus 11.

The display memory 5 is suitably a random access memory (RAM) which has a capacity for storing pixel information for one display page. The pixel information would comprise one or more information bits per pixel to be displayed, depending on the range of colours and attributes afforded by the table 10. A combined address-/data bus 15 interconnects the display generator 2, and the display memory 5 with the processor 3. The background memory 4, which is also at least partially a random access memory (RAM), is also connected to the address/data bus 15. The background memory 4 may also have a read-only memory (ROM) part of which contains permanent program data for controlling the "house-keeping" operations of the processor 3. The user interface apparatus 6 is a keyboard data entry device (KEY). The processor 3 can be a commercially available microprocessor (μp), for instance the Signetics S68000μP.

Figure 2:
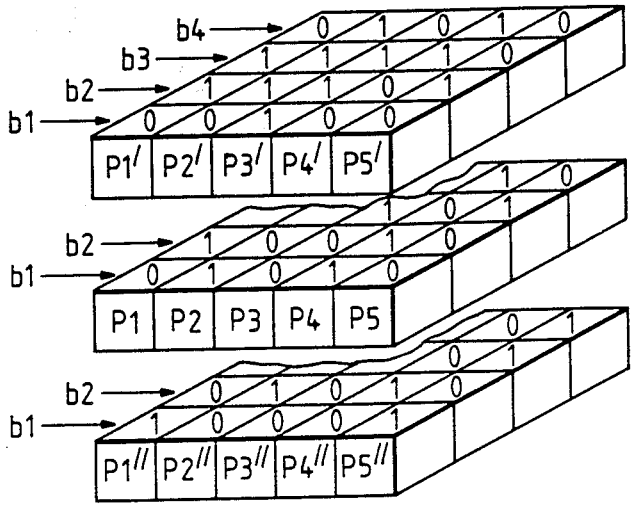
FIG. 2 shows diagrammatically the bit-map nature of the display memory of the arrangement of FIG. 1.

Data stored in the background memory 4 can be selected as required by the processor 3 under user control. Data representing one display page of pixel information at a time is read from the background memory 4 and written into the display memory 5. As shown in FIG. 2, it is assumed that pixels to be displayed in the selected display page are represented by respective digital codes having four bits b1 to b4. In FIG. 2, three groups of five pixel codes P1 to P5, P1' to P5' and P1'' to P5'' are illustrated and comprise the pixel information for pixels to be displayed in corresponding pixel positions in three successive scanning lines of both odd and even fields of the raster scan of the colour television monitor 1. In accordance with the invention each of these pixel codes is allocated to either one of two groups or categories. For the embodiment being described the value (0 to 1) of the bit b1 of each code determines to which group the code is allocated. This is the simplest way of distinguishing between the two groups. Otherwise, a decoder can be employed to decode any other bit number up to the entire four-bit codes. Such a decoder can be in the form of a code look-up table. A pixel code having its bit b1 of value 1 is assumed to belong to a "high" or "dominant" group of codes whose pixels are required to be rounded against each other if an appropriate diagonal relationship of pixels exists in adjacent scanning lines in each field. A pixel code having its bit b1 of value 0 is assumed to belong to a "low" or "non-dominant" group of codes whose pixels are not rounded against each other. Thus, in FIG. 2 pixel codes P3', P2, P4, P1'' and P5'' belong to the "high" group of codes and pixel codes P1', P2', P4', P5', P1, P3, P5, P2'', P3'' and P4'' belong to the "low" group of codes.

In certain applications, the digital codes could consist of one bit only, a first value representing a dominant code, the second value the non-dominant code.

ILLUSTRATION OF THE ROUNDING PRINCIPLE OF THE INVENTION

Figure 3A:
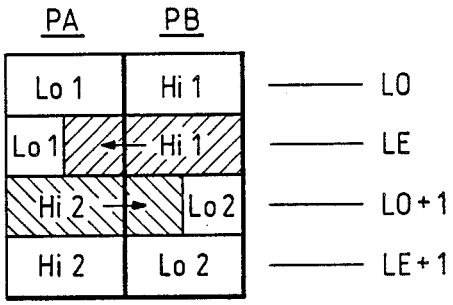

FIGS. *3a*, *3b* show diagrams which illustrate the principle of rounding in accordance with the present invention. Diagram (a) of FIG. 3 represents the display of four pixels in adjacent positions PA and PB in two scanning lines LO and LO+1 of the odd field and in two scanning lines LE and LE+1 of the even field. These pixels are Hi1 and Hi2 which represent by "high" codes and Lo1 and Lo2 which are represented by "low" codes. In the scanning line LE of the even field the pixel Hi1 is prerounded so as to extend halfway into the previous pixel position PA. This prerounding is due to the diagonal relationship between this pixel Hi1 and the pixel Hi2 in the succeeding scanning line LE+1, taken in conjunction with the presence of the pixel Lo1 in the scanning line LE and the pixel Lo2 in the scanning line LE+1 which are in the opposite diagonal relationship. Next, in the scanning line LO+1 of the odd field the pixel Hi2 is postrounded so as to extend into the following pixel position PB. This postrounding is due to the diagonal relationship between this pixel Hi2 and the pixel Hi1 in the preceding scanning line LO, taken in conjunction with the presence of the pixel Lo2 in the scanning line LO+1 and the pixel Lo1 in the scanning line LO, which are in the opposite diagonal relationship.

Figure 3B:
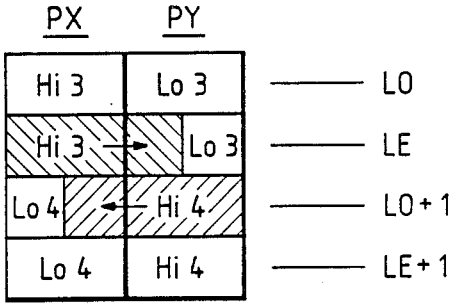
Figure 7A:
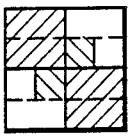
Figure 7C:
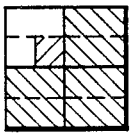
Figure 7D:
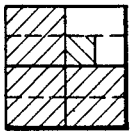
Figure 7B:
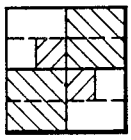
Figure 7E:
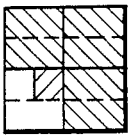
Figure 7F:
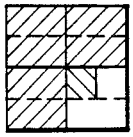

FIG. 3*b* represents the display of four further pixels in adjacent positions PX and PY in the two scanning lines LO and LO+1 of the odd field and in the two scanning lines LE and LE+1 of the even field. These pixels are Hi3 and Hi4 which are represented by "high" codes and Lo3 and Lo4 which are represented by "low" codes. In this instance, pixel Hi3 is postrounded and pixel Hi4 is prerounded. This rounding is due to diagonal relationships of the various pixels which correspond to those discussed above for FIG. 3*a*. Consideration of the above shows that for pixel rounding in a scanning line of an odd field, the pixel information for the preceding scanning line is required for both pre- and postrounding; whereas for pixel rounding in a scanning line of an even field, the pixel information for the succeeding scanning line is required for both pre- and postrounding.

DESCRIPTION OF A ROUNDING CIRCUIT

In the data display arrangement shown in FIG. 1, the display generator 2 includes a rounding circuit (RND) 16 to which is applied the pixel information received from the display memory 5 over the bus 11. A logic diagram for this rounding circuit 16 is shown in FIG. 4. This logic diagram comprises a line store 17 which has an input 18 connected to the bus 11 to receive pixel information read out from the display memory 5. This line store 17, which has a capacity for storing the pixel codes for one complete scanning line, is clocked at the pixel rate by the timer (TIM) over a lead 19*a* of a connection 19 (FIG. 1). Thus, there is produced at an output 20 of the line store 17 the pixel information read out from the display memory 5, but delayed by the period of one scanning line. This delayed pixel information is applied to two signal inputs e1 and o1 of a multiplexer 21, whilst the direct pixel information as read from the display memory 5 is applied to two further signal inputs e2 and o2 of this multiplexer 21. Within the multiplexer 21, the inputs o1 and o2 are connected respectively to two outputs Ro and Fo during the periods of odd fields and the inputs e1 and e2 are connected to the two outputs Fo and Ro, respectively during the periods of even fields, of the scanning action. The switching within the multiplexer 21 is effected by switching signals applied over another lead 19*b* of the connection 19 from the timer (TIM). The pixel information appearing at the output Fo will be termed a "fundamental" stream F and the pixel information appearing at the output Ro will be termed "reference" stream R. Each of these streams comprises successive 4-bit pixel codes. The pixel information stream F is applied to a first signal input 22 of a second multiplexer 23, and also to the input of a latch 24 and a first group decoder 25. The latch 24 produces at its output a delayed version F′ of the pixel information stream F: the delay is one pixel period. The output of the latch 24 is connected to a second signal input 26 of the multiplexer 23, which has an output 27 connected to the colour look-up table (CLUT). The pixel information stream R is applied to the input of a second group decoder 28. The two decoders 25 and 28 operate to determine whether each pixel code applied to them belongs to the "high" group or to the "low" group. Each decoder produces at its output a logic "1" signal for a "high" group code and a logic "0" signal for a "low" group code. These logic signals are applied to a logic network comprising two data flip-flops 29 and 30 and two AND-gates 31 and 32. The outputs of the two gates 31 and 32 are connected to respective inputs 33 and 34 of a further multiplexer 35 whose output 36 is connected to a control input 37 of the multiplexer 23. The latch 24, the two flip-flops 29 and 30 and the multiplexer 35 have respective clock inputs c1 to which pixel clock signals PC at the pixel rate are applied from the timer (TIM) over a further lead 19*c* of the connection 19.

The logic network comprising the elements 29 to 32 functions to detect the diagonal relationship of pixels, and the rounding circuit is responsive to such detection to effect pixel rounding in accordance with the criteria discussed previously with reference to FIGS. 2 and 3.

DESCRIPTION OF THE ROUNDING OPERATION

Two examples of the rounding operations will now be discussed in relation to the three groups of five pixel codes P1 to P5, P1′ to P5′ and P1″ to P5″ shown in FIG. 3. From the foregoing, it will be appreciated that the pixels represented by the pixel codes P1 to P5 are required to be rounded against the pixels represented by the pixel codes P1′ to P5′ in odd fields, and against the pixels represented by the pixel codes P1″ to P5″ in even fields. Referring now to FIG. 5, which shows timing diagrams for the operation of the rounding circuit for odd fields over a sequence of pixel periods pp1 to pp6, the group of pixel codes P1 to P5 is specified in row (i) as the "fundamental" stream F. Row (ii) specifies the same group of pixel codes P1 to P5, as produced at the output of the latch 24 with a delay of one pixel period, as the delayed "fundamental" stream F′. Row (iii) shows the group decoded categories (1=high, 0=low) of the pixel codes P1′ to P5′ of the preceding group of pixels which form the "reference" stream R for odd fields. Similarly, row (iv) shows the group decoded categories (1=high, 0=low) of the pixel codes P1 to P5 which form the fundamental stream F for odd fields. Row (v) shows the pixel clock PC which is active on its leading edge at the beginning of each pixel period. Rows (vi) and (vii) show the logic output levels (1 or 0) for the gates 31 and 32 in each pixel period. Gate 31 pertains to prerounding and gate 32 pertains to postrounding. More specifically, in the first pixel period pp1, both these gates are closed so that gate 31 produces a logic 0 output and gate 32 produces a logic 1 (0 inverted) output. Therefore, as shown in row (viii) during the first half of the first pixel period pp1 when the pixel clock is at logic 1, a switching signal SS at the output 36 of the multiplexer 35 is at logic 0. During the second half of the first pixel period pp1 when the pixel clock is at logic 0, the switching signal SS is at logic 1. The multiplexer 23 is switched to feed the undelayed fundamental pixel information stream F to the colour look-up table (CLUT) when the switching signal SS is at logic 1, and to feed the delayed fundamental pixel information stream F′ thereto when the switching signal SS is at logic 0. The same operation occurs for the second pixel period pp2 in which both the gates 31 and 32 are again closed. For the third pixel period pp3 the gate 31 remains closed, but the gate 32 is open due to the logic 1 at the output of decoder 28, the logic 0 at the output of decoder 25, the logic 1 at the output of flip-flop 29, and the logic 0 at the output of the flip-flop 30.

During the first half of the third pixel period pp3 when the pixel clock is at logic 1, the switching signal SS is at logic 0 due to the logic 0 at the output of the gate 31. There is now a logic 0 at the output of the gate 32 as well so that the switching signal SS remains at logic 0 for the second half of the third pixel period pp3. As a result, the delayed fundamental pixel information stream F′ is selected for the display for the first half of third pixel period pp3, and the delayed fundamental pixel code stream F′ is also selected for the second half of the third pixel period pp3. Thus, postrounding has occurred by extending the pixel code P2 in the delayed second pixel period pp2 into the first half of the delayed third pixel period pp3 (row ix). For the fourth pixel period pp4, the gate 32 remains closed, but the gate 31 is open due to the logic 1 at the output of decoder 25, the logic 0 at the output of decoder 28, the logic 1 at the output of flip-flop 30 and the logic 0 at the output of flip-flop 29. During the first half of the fourth pixel period pp4 when the pixel clock is at logic 1, the switching signal SS is at logic 1 due to the logic 1 at the output of the gate 31. Gate 32 is producing a logic 1 output so that the switching signal SS remains at logic 1 for the second half of the fourth pixel period pp4. As a result, the undelayed fundamental pixel information stream F is selected for the display for the entire fourth pixel period pp4. However, since the output to display (row ix) is delayed by one half a pixel period, the effect is to be preround by extending the pixel code P4 in the delayed fourth pixel period pp4 into the second half of the delayed third pixel period pp3.

For the fifth pixel period pp5, gates 31 and 32 have logic 0 and logic 1 outputs, respectively, so that the unrounded condition pertains, as for the first and second pixel periods pp1 and pp2. As a consequence, the pixel information streams F′ and F are selected for the first and the second halves, respectively, of the fifth pixel period pp5. The resultant pixel information RPS stream fed to the colour look-up table (CLUT) is the same as the fundamental pixel information stream F, but delayed by one half a pixel period as shown in row (ix).

Similar operations are carried out for pre- and postrounding in even fields for which the pixel represented by the pixel codes P1 to P5 are rounded against the pixel represented by the pixel codes P1″ to P5″. The timing diagrams for these operations of the rounding circuit are shown in FIG. 6. From these timing diagrams, it can be seen that the pixel codes P2 in the second pixel period pp2 is prerounded by extending it into the second half of the first pixel period pp1, and that the pixel code P4 in the fourth period pp4 is postrounded by extending it into the first half of the fifth pixel period pp5. Because rounding on a current scan line in even fields requires the pixel codes in the succeeding scan line, the timer TIM (FIG. 1) is organised so that the pixel codes read out from display memory 5 and applied to the rounding circuit 16 in even fields are advanced by one scan line. This allows the (advanced) preceding line from the line store 17 to be used as the fundamental pixel stream F (and F′) in even fields to produce the display.

Summarizing, the effects shown in FIGS. 5, 6 can be explained as follows. If no prerounding or postrounding occurs, the effect of the method is to delay all of the picture field by one half period. This is realized by using for the second half of the pixel period always the undelayed fundamental information and for the first half of the next pixel period the delayed fundamental information. Thus, the first half pixel period of any scanning line in effect is not used. If prerounding or postrounding occurs (impossible for the first half pixel period of a scanning line) the above selection may be inverted. Thus a fundamental pixel information may be displayed for any number of half pixel periods from zero half pixel periods (P3 in FIG. 5) up to four half pixel periods (not shown in FIGS. 5, 6).

EXTENDED FEATURES ACCORDING TO THE INVENTION

The rounding circuit of FIG. 4 has a logic network which detects diagonal relationships of pixels as illustrated in FIGS. *7a*, *7b*, but does not detect diagonal relationships of pixels as illustrated in FIGS. *7c* . . *7f*. The former two diagonal relationships are analogous to the smooth single width diagonal relationships which are detected for character rounding. However, detecting and rounding these two diagonal relationships only, may not be appropriate for free format graphics displays, where alternatively or additionally it may be required to round other diagonal relationships such as those illustrated in FIGS. *7c* . . *7f*. The alternative detection can be effected in the rounding circuit of FIG. 4 simply by an appropriate change in the connections of the logic network so as to identify three "high" group codes in each four element group, instead of two diagonally opposed "high" group codes and two diagonally opposed "low" group codes. Furthermore, the rounding can be realised for all of the cases of FIGS. *7a* through *7f*. Then, only two diagonally opposed "high" group codes in combination with a single "low" group code in a group of four need be detected, the fourth group being considered as "don't care".

Finally, the detection of the situations of FIGS. *7c* through *7f* may be realised in addition to cases of FIGS. *7a*, *7b*, but for a different discrimination level between "high" codes and "low" codes. In effect, this would need double level detection and double generators for the rounding signals. Alternatively, the latter function can be realised by dividing the pixels with "high" codes into two groups and providing two group decoders for determining these two groups. The logic networks would then be switched to perform detection of one diagonal relationship or the other in dependence on which "high" group decoder provides an output.

I claim:

1. A method for reducing the coarseness of a plurality of displayed information pixels, each of which pixels is represented by a respective digital code stored in a display memory, said digital codes being accessed repeatedly to display the information pixels in a recurrent cycle of scanning lines, with each row of information pixels being displayed twice in adjacent scanning lines and wherein each digital code either belongs to a dominant group of codes or to a non-dominant group of codes which are distinguished by the value of at least one bit position, said method comprising the steps of:

(a) obtaining from the display memory the digital codes of the current row of information pixels for the current scanning line as undelayed fundamental pixel information, and producing a second version thereof which is delayed by one pixel period as delayed fundamental pixel information;

(b) obtaining from the display memory, the digital codes of the preceding row of information pixels during the first occurrence of the current row of information pixels, as reference information, and the digital codes of the succeeding row of information pixels during the second occurrence of the current row of information pixels, as reference information;

(c) detecting allocations to said two groups from two successive undelayed fundamental information pixels, and two successive reference information pixels the existence of an allocation of two diagonally opposed information pixels having codes belonging to a dominant group, and a further fundamental information pixel having a code belonging to said non-dominant group, such allocation representing a predetermined diagonal relationship;

(d) selecting for producing the pixel display in the second half of each pixel period the undelayed fundamental pixel information and in the first half of the next pixel period the delayed fundamental pixel information, when said diagonal relationship is not detected;

(e) when a first predetermined diagonal relationship is detected, prerounding a pixel of said dominant group by selecting for said first half of a pixel period the undelayed fundamental information and upon detecting a further predetermined diagonal relationship, postrounding a pixel allocated to said dominant group by selecting for the second half of a pixel period the delayed fundamental information, such prerounding and postrounding thereby suppressing a half pixel originally allocated to said non-dominant group.

2. A pixel rounding method as claimed in claim 1, wherein the digital codes for the preceding row of information pixels are obtained by delaying the digital codes for each row of information pixels by one line scan period following read out of said digital codes from the display memory.

3. A pixel rounding method as claimed in claim 1 or claim 2, wherein the digital codes for the succeeding row of information pixels are obtained by reading out the digital codes from the display memory with an advance of one scanning line relative to the display, delaying said readout codes by one line scan period to serve as the fundamental pixel information, and using said codes directly as the reference pixel information.

4. A pixel rounding method as claimed in claim 1, wherein successive four element groups of pixel codes, two codes in each of the fundamental and the reference pixel information, are examined to detect the presence of two diagonally pixel codes of one group and two diagonally pixel codes of the opposite group.

5. A pixel rounding method as claimed in claim 1, wherein successive four element groups of pixel codes, two codes in each of the fundamental and the reference pixel information, are examined to detect the presence of one code of the non-dominant group and three codes of the dominant group.

6. A pixel rounding method as claimed in claim 4 or claim 5, further comprising the step of dividing one group of codes into two sub-groups and selectively performing one or the other detection examinations in accordance with the sub-group to which the codes of said one group belong.

7. A pixel rounding method as claimed in claim 1, wherein said digital codes contain a single bit and said dominant and non-dominant groups each contain a single code.

8. A pixel rounding method as claimed in claim 1, wherein said digital codes contain at least two bits and said dominant and non-dominant groups each contain at least two, mutually exclusive, codes.

9. A pixel rounding method as claimed in claim 8, wherein the distinction between a dominant code and a non-dominant code is dependent on a single bit.

10. A pixel rounding circuit for rounding pixels comprising:

a. input means fed by said display memory for receiving a sequence of fundamental information pixels and reference information pixels in synchronism with a pixel clock rate;

b. latch means fed by said input means for receiving said fundamental information pixels and which is operable at said pixel clock rate to produce a delayed version of said fundamental pixel information;

c. a first multiplexer fed by said input means to receive said fundamental information pixels and by said latch means to receive said delayed fundamental pixel information;

d. group decoding means fed by said input means for receiving the fundamental and reference information pixels and for each pixel information received producing a binary signal indication indicating said pixel as belonging to a non-dominant group or a dominant group; said dominant group and non-dominant group being distinguished by at least the value of one bit position of a respective pixel;

e. storage means fed by said decoding means for storing said indications;

f. detection means fed by said group decoding means and said storage means for receiving said indications pertaining to at least two fundamental information pixels plus associated reference information pixels, for detecting the occurrence of predetermined diagonal relationships, and for signalling said occurrences on a rerounding output and a postrounding output respectively; and, g. a second multiplexer fed by said prerounding output and said postrounding output, and an output which is connected to a switching input of the first multiplexer, said second multiplexer being switched at said pixel clock rate to connect its output to said prerounding output for the first half of each pixel period and to connect its output to said postrounding output for the second half of each pixel period, a resultant switching signal at the second multiplexer output switching the first multiplexer so as to connect an output thereof to either of its inputs.

11. A pixel rounding circuit for performing pixel rounding comprising:

(i) a first multiplexer having a first input to which fundamental pixel information is applied;

(ii) a latch to which the fundamental pixel information is also applied, and which is operable at a pixel clock rate to produce a delayed version of the fundamental pixel information, a second input of the first multiplexer having said delayed version of the fundamental pixel information applied to it;

(iii) two group decoders to which the fundamental and the reference pixel information are applied, respectively, and which produce a logic 0 or a logic 1 output when the digital codes forming the pixel information applied to said group decoders belong to one of two groups as determined by the decoders;

(iv) two flip-flops having inputs connected respectively to outputs of the two group decoders, which flip-flops are driven at the pixel clock rate so as to produce at respective outputs the logic 0 or 1 value applied to their inputs from the relevant decoder in the preceding pixel period;

(v) two AND-gates, each having four inputs connected respectively to the two decoder outputs and the two flip-flop outputs, one AND-gate producing a logic 1 output to request pixel prerounding, and the other AND-gate producing a logic 0 output to request pixel postrounding; and (vi) a second multiplexer which has first and second inputs connected respectively to the outputs of the two AND-gates, and an output which is connected to a switching input of the first multiplexer, said second multiplexer being switched at said pixel clock rate to connect its output to its prerounding input for the first half of each pixel period and to connect its output to its postrounding input for the second half of each pixel period, a resultant switching signal at the second multiplexer output switching the first multiplexer so as to connect an output thereof to its first input when the switching signal is at logic 1 and to its second input when the switching signal is at logic 0 value.

12. A pixel rounding circuit as claimed in claim 10, wherein said input means includes a line store connected to receive and store the digital codes for each scanning line of pixels read from the display memory, said line store being driven at said pixel clock rate so as to produce at its output the stored digital codes delayed by one scan line period, the input means also including a third multiplexer having first and second inputs connected to receive the digital codes for the current scanning line received from the display memory and third and fourth inputs connected to receive the digital codes as produced at the output of the line store, the third multiplexer being switched so that for the first occurrence of the current scanning line its first input is connected to a first output thereof to provide the digital codes from the line store as the fundamental pixel information, and its third input is connected to a second output thereof to provide the digital codes from the line store as the reference pixel information, whereas for the second occurrence of the current scanning line the fourth input of the third multiplexer is connected to the first output to provide the digital codes from the line store as the fundamental pixel information, when its second output is connected to the second output to provide the digital codes for the current scanning line as the reference pixel information, the rounding circuit receiving the digital codes for the second occurrence of the current scanning line of pixel information with an advance of one line scan period.

13. A raster scan display device comprising a circuit as claimed in any of claims 10, 11, 12 and further comprising a display element fed by said pixel rounding circuit.

* * * * *